US006925692B2

(12) United States Patent
Yang

(10) Patent No.: US 6,925,692 B2
(45) Date of Patent: Aug. 9, 2005

(54) EASY-LOCKING BUCKLE STRUCTURE

(76) Inventor: Shih Sheng Yang, P.O. Box 82-144, Taipei (TW)

( * ) Notice: Subject to any disclaimer, the term of this patent is extended or adjusted under 35 U.S.C. 154(b) by 45 days.

(21) Appl. No.: 10/656,145

(22) Filed: Sep. 8, 2003

(65) Prior Publication Data

US 2005/0050693 A1 Mar. 10, 2005

(51) Int. Cl.[7] ..... A44B 17/00
(52) U.S. Cl. ..... 24/681; 24/689; 24/691
(58) Field of Search ..... 24/618–625, 681, 24/662, 687–692, 108

(56) References Cited

U.S. PATENT DOCUMENTS 4,378,082 A * 3/1983 Chica ..... 224/243
4,608,734 A * 9/1986 Schiller ..... 24/104
4,967,451 A * 11/1990 Boyn ..... 24/30.5 R
5,178,198 A * 1/1993 Fitzgerald ..... 150/107
5,441,187 A * 8/1995 Mixson ..... 224/243
6,273,020 B1 * 8/2001 D'Alessandro ..... 114/364

* cited by examiner

*Primary Examiner*—James R. Brittain
(74) *Attorney, Agent, or Firm*—Leong C. Lei

(57) ABSTRACT

An easy-locking buckle structure is composed of a male buckle element and a female buckle element having a smaller area than that of the male buckle element. A post extends downwardly from the bottom of one end of the male buckle element for engagement with a socket with a cylinder, while an upwardly raising holding tab is provided at the other end of the male buckle element. A conical recess with a through hole is provided in the center of the female buckle element. Said conical recess is provided with slots at its sides for connecting with a socket. Holes are pre-punched on the articles to be applied with the buckle such that the post of the male buckle element can pass through and engage with the socket, while the connecting pins of the female buckle element pass through the punched holes on the article such that the conical recess with the hole can aim at and pass through the punched hole on the article before the socket under the article is locked with the female buckle element.

7 Claims, 6 Drawing Sheets

EASY-LOCKING BUCKLE STRUCTURE

BACKGROUND OF THE INVENTION (a) Technical Field of the Invention

The present invention relates to an easy-locking buckle structure, particularly to a buckle structure enabling a user to lock and detach the male and female buckle elements easily. The buckle structure according to the invention is applicable to those article which need to be frequently locked and detached, regardless of whether they are soft or hard articles.

(b) Description of the Prior Art

The conventional buckle structure, such as that disclosed in R.O.C. Approval No. 364303 titled entitled "press buckle", is composed of a male buckle set and a female buckle set. The male buckle set further comprises of a buckle face and a male buckle element. The buckle face is substantially in the form of a T shape with a taper-form connecting bar vertically extending from the bottom thereof. The male buckle element is disk-shaped in appearance and has an extrusion in the form of a neck at one end. While the male buckle element has a central pass for pivotally connecting to the connecting bar, a woven fabric layer is provided in-between the male buckle element and the buckle face. The female buckle set is composed of a buckle face and a female buckle element. While the buckle face is in the form of a T shape, the female buckle element has a main body in the form of a U shape, under which a central hole is provided for pivotally connecting with the connecting bar under the buckle face. A woven fabric layer is provided in-between the female buckle element and the buckle face. An outer peripheral edge is provided on the top of the female buckle main body, while the space inside of the female buckle main body may allow the extrusion of the male buckle to stick inside.

However, in the above-mentioned prior art, when combining the male and female buckle sets together, there exist some disadvantages, as follows:

1. The user must press the buckle sets with force so that they can lock together. This may be quite inconvenient for a female user.

2. In connection with the combination of the male and female buckle sets, as the female buckle is designed to have substantially the same bore diameter as the outer diameter of the male buckle, it is not easy for the user to operate the buckle elements, and particularly to position them.

3. When separating the buckle elements, in the absence of the holding tab, the user must pull and drag the woven fabric layer therebetween, which will always eventually tear, given the firm combination of the male and female buckle elements.

In view of the afore-mentioned disadvantages carried by the structure of the prior art, the present invention is disclosed to improve said disadvantages, reduce costs, provide a holding tab, etc., in order to ease the combination pressure of the buckle structure with the articles, and to facilitate the user to hold and operate the buckle.

SUMMARY OF THE INVENTION

The primary object of the invention is to provide an easy-locking buckle structure, which can allow quick combination of the buckle and the article.

The secondary object of the invention is to provide an easy-locking buckle structure, which can make it easier for the user to hold and operate.

Yet another object of the invention is to provide an easy-locking buckle structure, which can allow a better elastic-locking effect of the buckle, thereby extending the life of the buckle.

To obtain the above objects, the invention is composed of a male buckle element in the form of a tab and a female buckle element having a smaller area than that of the male buckle element. A post extends downwardly from the bottom of one end of the male buckle element for engagement with a socket having a cylinder, while an upwardly raising holding tab is provided at the other end of the male buckle element. A conical recess with a through hole is provided in the center of the female buckle element. Said conical recess is provided with slots at the sides and connecting pins at the bottom for connecting with a socket which has a through hole in the center. Holes are pre-punched on the articles to be provided with the buckle for the post of the male buckle element to pass through and engage with the socket, while the connecting pins of the female buckle element pass through the punched holes on the article such that the funnel-form tube with the hole can aim at and pass through the punched hole on the article before the socket under the article is locked with the female buckle element. By way of the engagement of the post of the male buckle element with the hole of the female buckle element, the integral buckle can be locked and detached repeatedly. The slightly upward holding tab of the male buckle element can make it easier for the user to operate the buckle structure.

Many other advantages and features of the present invention will become manifest to those versed in the art upon making reference to the detailed description and the accompanying drawings in which preferred structural embodiments incorporating the principles of the present invention are shown by way of illustrative example.

DETAILED DESCRIPTION OF THE PREFERRED EMBODIMENT

Figure 1:
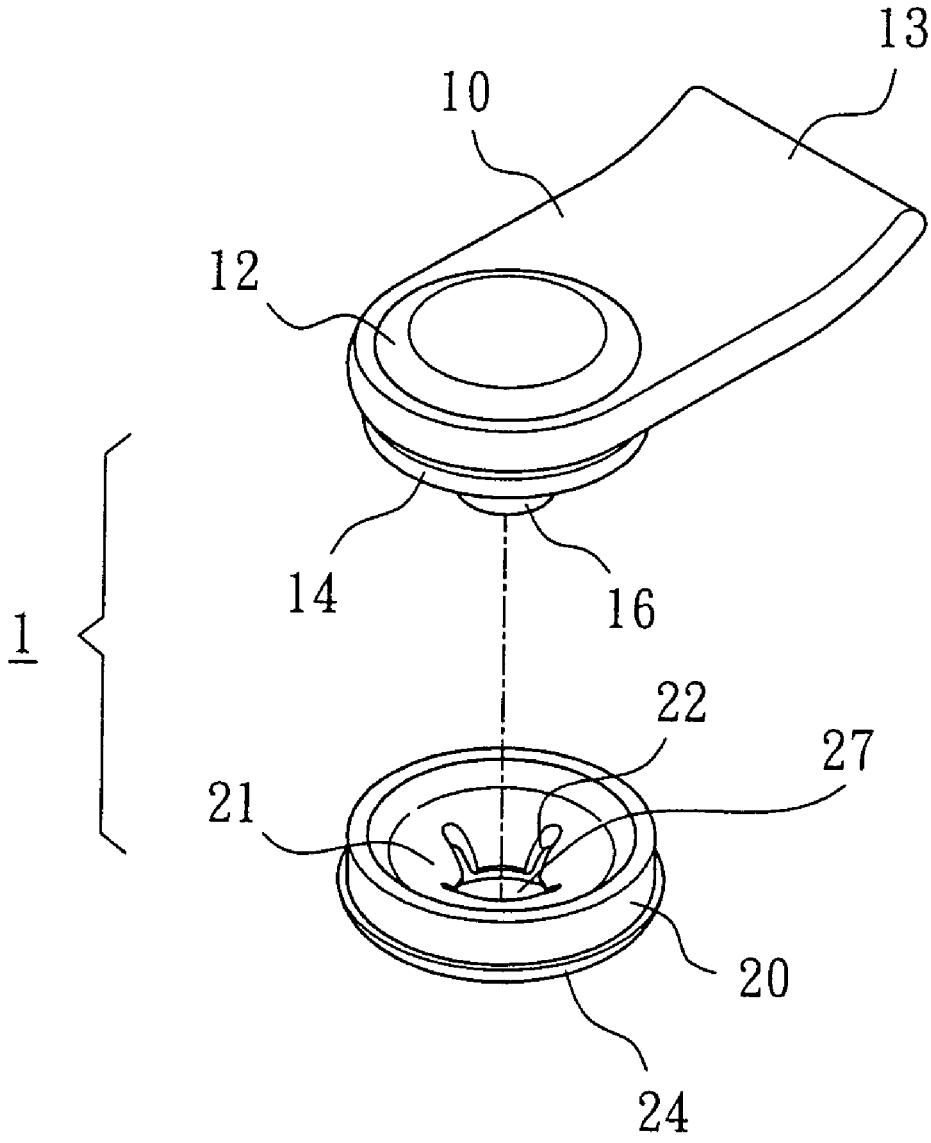
FIG. 1 is a perspective view of the invention.
Figure 2:
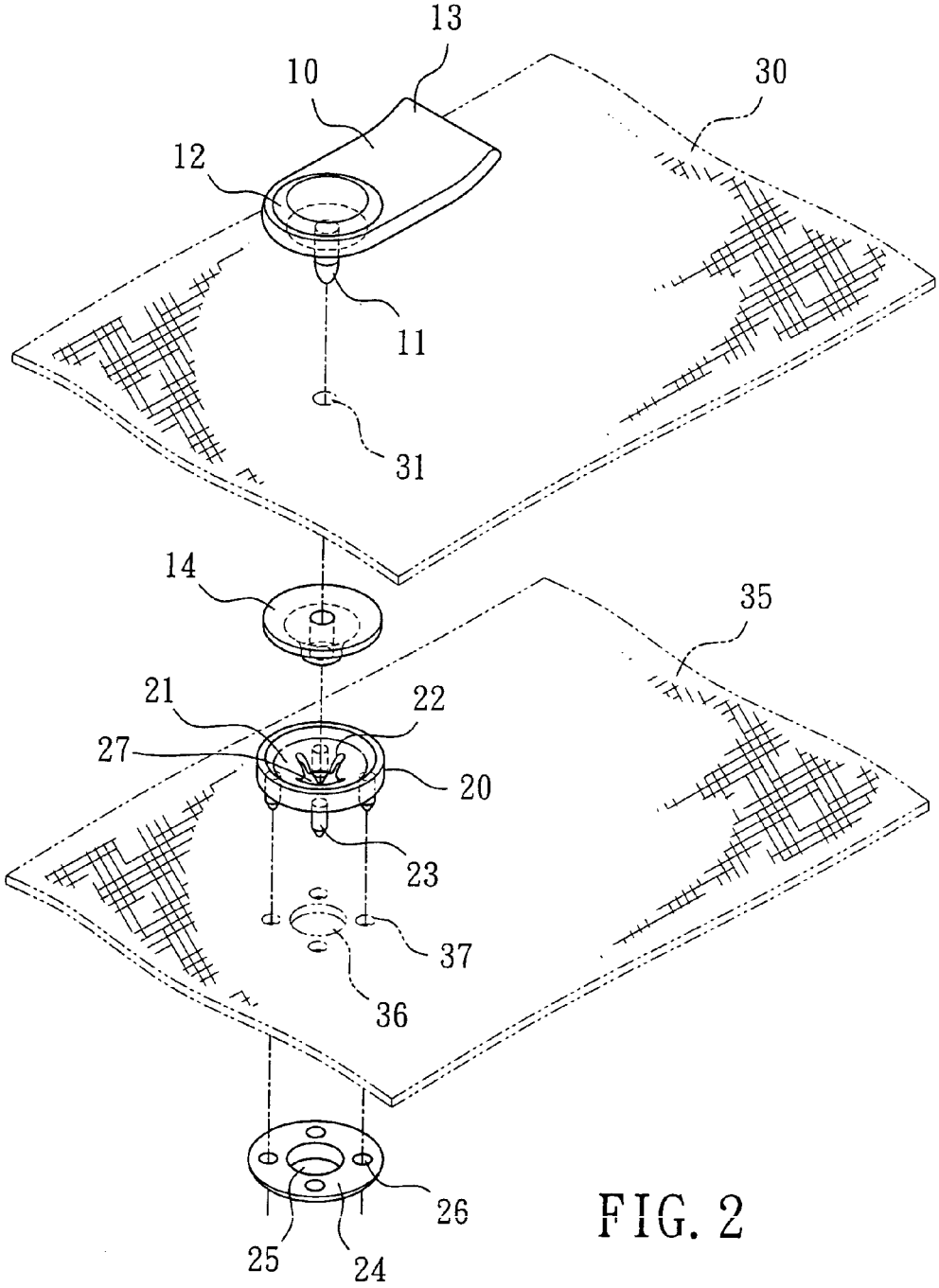
FIG. 2 is an exploded view of the invention.
Figure 3:
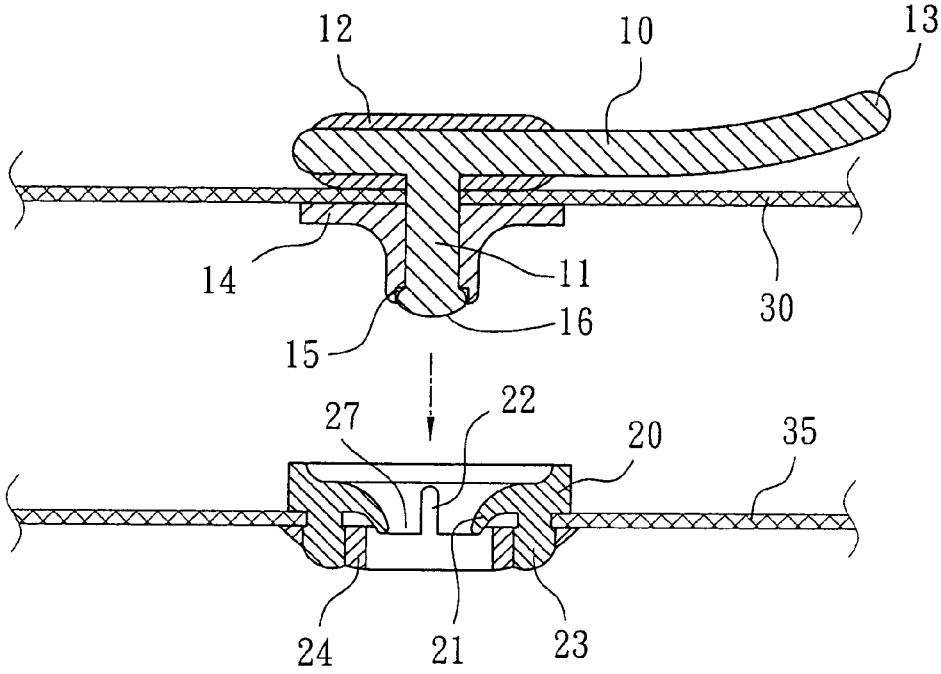
FIG. 3 is a cut-away view of the invention showing the male and female buckle elements in detached status.

Referring to FIGS. 1 and 2, the buckle structure 1 according to the invention is composed of a male buckle element 10 in the form of a rectangular tab and a female buckle element 20 having a smaller area than that of the male buckle element. The fore end of the rectangular tab is formed around a round press button, below the center of which a post 11 extends downwardly. The top of the press button may combine with a cover 12, while the top of the post 11 may engage with a socket 14 in the form of a cylinder with a hole. The post 11 may be pressed with the socket to become a blunt end 16. The inner edge of the top of the cylinder with a hole can be provided with a depressed step edge 15 (as shown in FIG. 3). The other end of the tab raising upwardly to form a holding tab 13.

The female buckle element 20 is combined with the male buckle element 10 by means of the socket 14. A conical recess 21 with a hole 27 is provided in the center of the female buckle element 20, while the bottom surface of the conical recess 21 is provided with a plurality of connecting pins 23 for connecting to a socket 24 which is correspondingly provided with a through hole 25 and connecting holes 26.

Referring to FIGS. 2 and 3, to have articles 30 and 35 locked together, a hole 31 must be pre-punched on the article 30 at an appropriate position, such that the post 11 of the male buckle element 10 can pass through the hole 31 on the article 30. The socket 14 below the article 30 is engaged with the post 11 through the article 30 to the depressed step edge 15 at the inner edge of the top of the cylinder with a hole and firmly connected at the blunt end 16 mounted on the extending pillar 11, thereby the article 30, male buckle element 10 and the socket 14 are combined integrally. The blunt end 16 mounted on the extending pillar 11 is engaged inside of the depressed step edge 15, such that the male buckle element 10 keeps the socket 14 at greatest connecting size in respect of the outer diameter of the cylinder.

Meanwhile, a hole 36 and a plurality of connecting holes 37 are pre-punched on the article 35 at appropriate positions before passing the connecting pins 23 of the female buckle element 20 through the connecting holes 37 of the article 35, such that the hole 27 in the conical recess 21 of the female buckle element 20 can aim at the hole 36 at the article 35. The connecting holes 26 of the socket 24 under the article 35 are engaged with the connecting pins 23 of the female buckle element 20. The connecting pins 23 are made by pressure to become blunt ends for locking purposes. The female buckle element 20, the article 35 and the socket 24 are combined integrally, so that the invention has been duly assembled.

Figure 4:
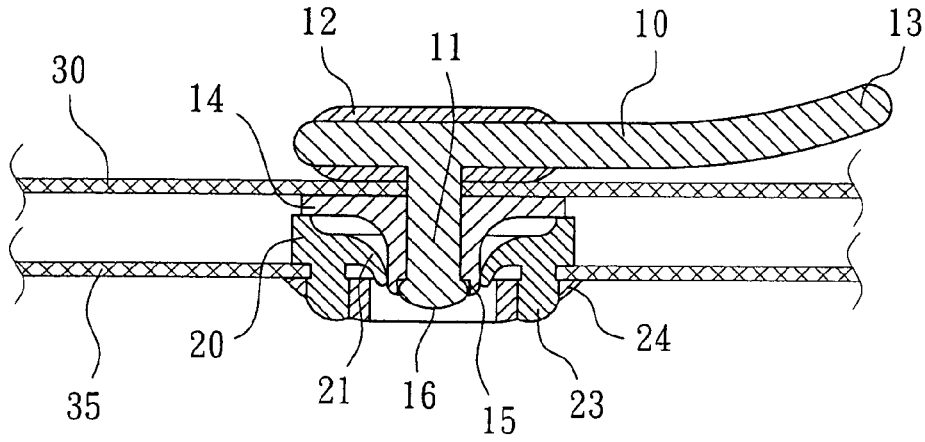
FIG. 4 is a cutaway view of the invention showing the male and female buckle elements in locking status.
Figure 5:
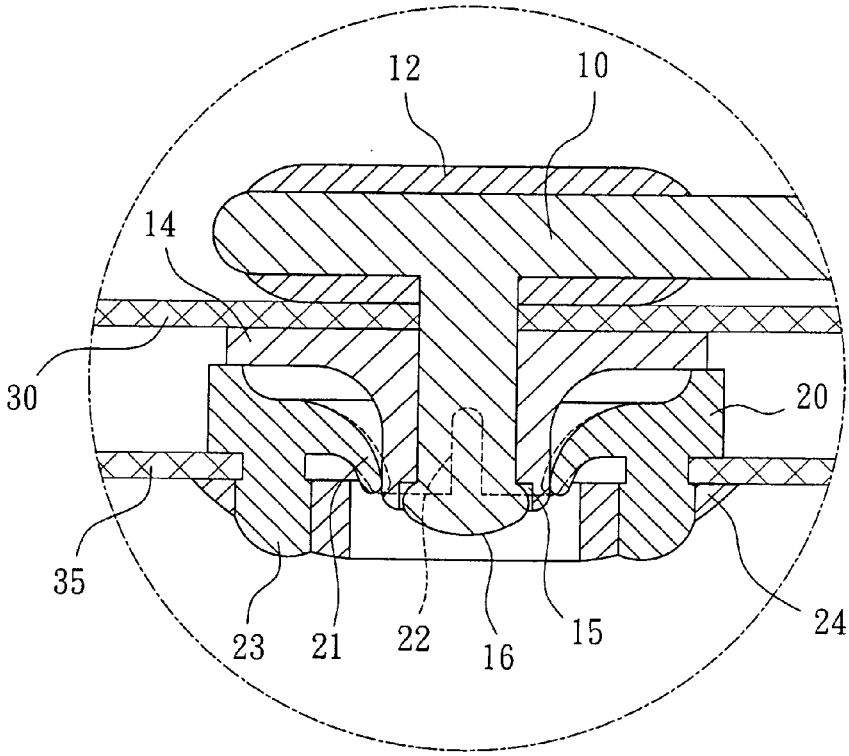
FIG. 5 is a partially enlarged view taken from FIG. 4.

Referring to FIGS. 3 to 5, when in use, one simply needs to place the extending pillar 11 of the socket 14 engaged at the bottom of the female buckle element 10 above the hole 27 of the conical recess 21 at the center of the female buckle element 20 without aiming a position, and is pressed downwardly such that the extending pillar 11 at the bottom of the socket 14 can easily slide along the arc surface of the conical recess 21 and reach the male buckle element 10 to engage in the hole 27 of the female buckle element 20.

As a plurality of slots 22 are provided on the sides of the conical recess 21 of the female buckle element 20, the conical recess 21 is extendable such that the sides thereof can extend outwardly and stick to the post 11 of the male buckle element 10 when the socket 14 enters into the hole 27. As shown in FIG. 5, when the male and female buckle elements are locked together, the articles 30 and 35 can be combined into one. In view of the provision of the conical recess 21, the positioning becomes easier. Furthermore, the design of the slots 22 allows the bore diameter of the hole 27 to lessen.

Further referring to FIG. 4, when separating articles 30 and 35, the user only needs to lift the holding tab 13 of the male buckle element 10, and the post 11 along with the socket 14 will easily detach from the hole 27 on the conical recess 21 of the female buckle element 20.

Figure 6:
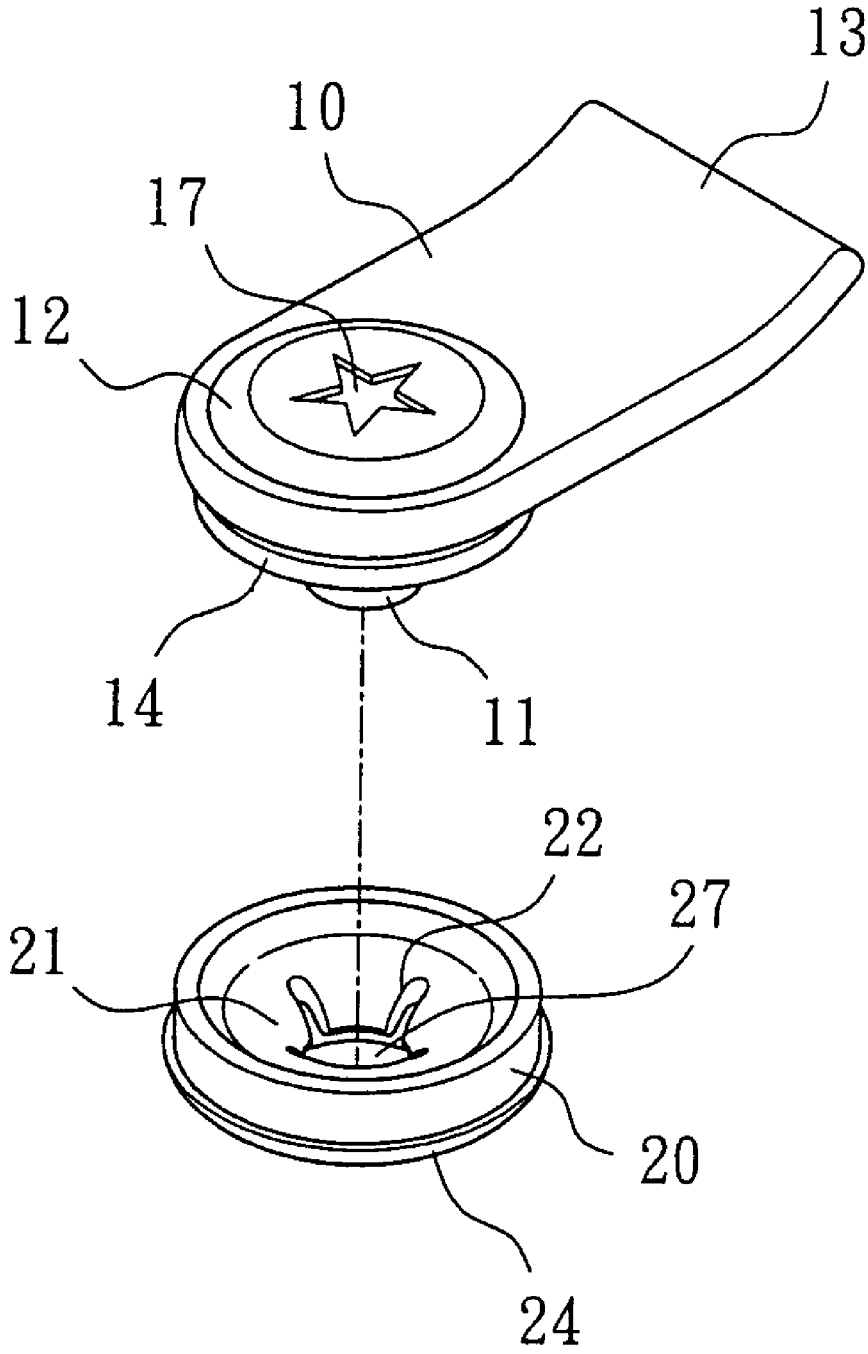
FIG. 6 is a perspective view of another embodiment of the invention.
Figure 7:
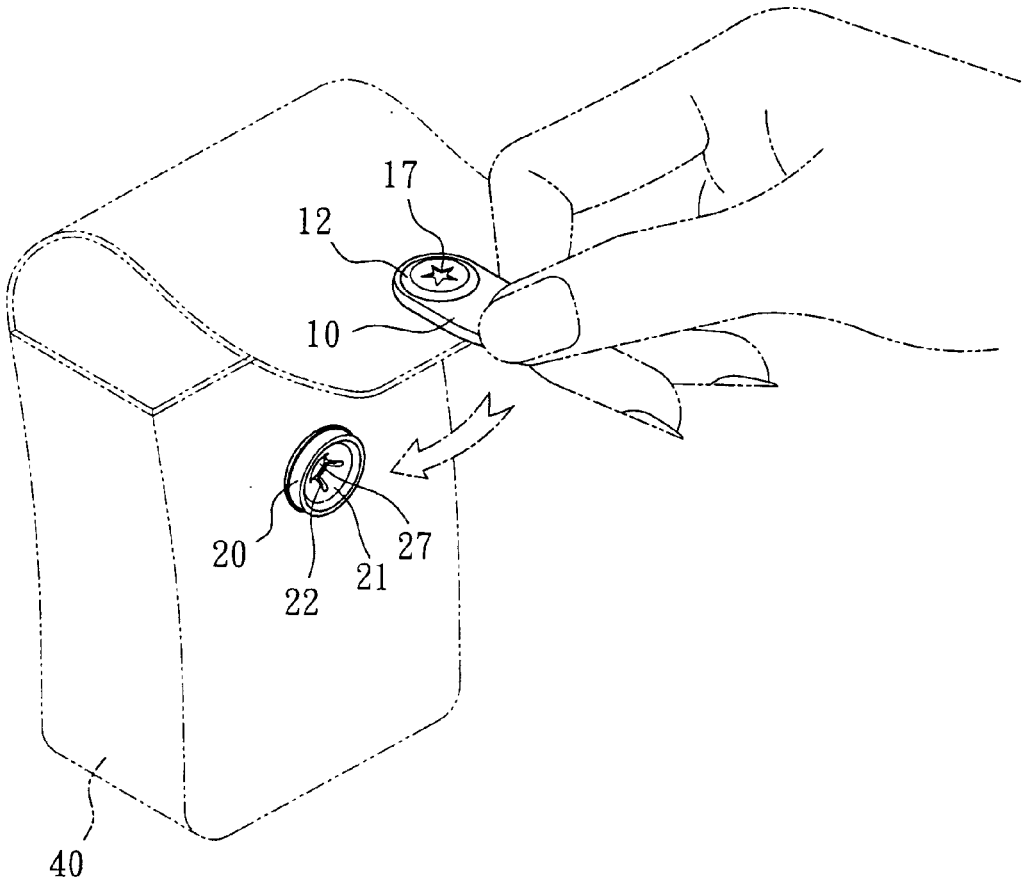
FIG. 7 shows an exemplified application of the invention.

As shown in FIGS. 6 and 7, in order to stimulate the consumers to purchase the commodity and to enrich the aesthetically pleasing feeling of the commodity itself, before covering the male buckle element 10 with the cover 12, a trademark logo 17 can be pre-imprinted on the cover 12, such that the surface of the male buckle element 10 may bear a beautiful logo 17 (as shown in FIG. 6). When applying the invention to a mobile phone case 40, the mobile phone case 40 can be closed and opened easily. In addition, the logo 17 shown on the cover 12 may further enhance the aesthetically pleasing feeling of the mobile phone case 40.

Concluded above, the invention discloses an easy-locking buckle structure, which is provided with a holding tab enabling the user to operate the buckle, and making the combination of the buckle and the articles much easier. Meanwhile, the invention can enrich the view effect of the whole article. In view of the novelty and environmental concepts embraced by the present invention, as well as the value applicable to the filed, the inventor claims the invention as specified in the following claims.

I claim:

1. An easy-locking buckle structure, comprising:

(a) a male buckle element in form of a rectangular tab, being provided with a post extending downwardly from a bottom of one end, and a first cover on a top, the post being engaged with a socket having a hole, a holding tab being provided at the other end of the male buckle element; and (b) a female buckle element having a hole in a bottom of a conical recess provided with slots at sides and a plurality of connecting pins at a bottom for combining to a second cover;

thereby after the male and female buckle elements are combined together, the male and female buckle elements are locked and detached repeatedly.

2. The easy locking buckle structure according to claim 1, wherein the holding tab of the male buckle element raises toward a direction opposite to the post.

3. The easy-locking buckle structure according to claim 1, wherein a blunt end having a greater outer diameter than that of the post is provided on a top of the post of the male buckle element.

4. The easy-locking buckle structure according to claim 1, wherein a depressed step edge is provided at an inner periphery of the hole of the socket engaged with the post of the male buckle element.

5. The easy-locking buckle structure according to claim 1, wherein a cylinder of the socket of the male buckle element has a length shorter than that of the post.

6. The easy-locking buckle structure according to claim 1, wherein a logo is provided on the first cover of the male buckle element.

7. The easy-locking buckle structure according to claim 1, wherein a plurality of slots are provided on the sides of the conical recess of the female buckle element.

* * * * *